United States Patent [19]

Benson

[11] 4,167,255

[45] Sep. 11, 1979

[54] ELECTRICIAN STUD GRIP

[76] Inventor: Laurence B. Benson, 836 E. Washington, Burns, Oreg. 97720

[21] Appl. No.: 737,204

[22] Filed: Nov. 1, 1976

[51] Int. Cl.[2] ..... E04G 3/00; B65H 49/00

[52] U.S. Cl. ..... 242/129; 248/218.4; 248/246

[58] Field of Search ..... 248/246, 219.1, 217.1, 248/226.2, 230; 242/129

[56] References Cited

U.S. PATENT DOCUMENTS

| | | | |
|---|---|---|---|
| 216,008 | 5/1879 | Wilson | 248/217.1 X |
| 1,409,800 | 3/1922 | Turner | 248/217.1 X |
| 1,545,740 | 7/1925 | Cowell | 248/217.1 X |
| 1,597,095 | 8/1926 | Martinsen | 248/246 |
| 2,123,695 | 7/1938 | Elmer | 248/246 X |
| 2,605,074 | 7/1952 | Bucsko et al. | 248/219.1 X |
| 2,891,759 | 6/1959 | Holmboe, Sr. | 248/246 X |
| 3,017,136 | 1/1962 | Noffke | 242/129 |
| 3,353,778 | 11/1967 | Sylvain et al. | 248/246 X |

FOREIGN PATENT DOCUMENTS

| | | | |
|---|---|---|---|
| 3942 | 7/1891 | Switzerland | 248/217.1 |
| 174291 | 4/1934 | Switzerland | 248/217.1 |
| 345063 | 3/1931 | United Kingdom | 248/246 |
| 433468 | 8/1935 | United Kingdom | 248/217.1 |

*Primary Examiner*—Roy D. Frazier
*Assistant Examiner*—Peter A. Aschenbrenner
*Attorney, Agent, or Firm*—Kolisch, Hartwell, Dickinson & Stuart

[57] ABSTRACT

A stud grip or clamp bracket for removable mounting onto a building stud. The bracket includes a generally channel-shaped end which permits lateral positioning of the bracket toward a stud for engagement therewith. An elongate pivot arm is pivotally connected intermediate its ends to the bracket for engaging the stud such that the stud is clamped or frictionally engaged between the channel-shaped end and a contacting end of the arm. A coil of cable may be suspended from the pivot arm so that the cable may be paid out for installation in a home or building.

6 Claims, 5 Drawing Figures

ELECTRICIAN STUD GRIP

BACKGROUND OF THE INVENTION

The present invention relates to devices for aiding in the dispensing of cable or the like, and more particularly to a so-called stud grip or clamp bracket which may be removably clamped to a building stud member for permitting a coil or cable to be rotatably suspended therefrom. The coil of cable is mounted on a reel which is connected by a swivel to the clamp bracket.

Typically, electrical cable is packaged in coils which must be uncoiled from a box or carton. In home and building construction, electricians install electrical cable for the various electrical outlets, etc. from such coils of electrical cable. To facilitate installation, it is desirable to fix coils of the cable on reels so that the cable may be readily paid out for attachment to the home or building. Without the use of such a reel, the electrician must tediously and inefficiently unwind the cable by hand from the coil.

While it has been proposed to situate coils of electrical cable on reels for dispensing, such reels must be placed upon a floor surface and thus take up space. Such dispenser reels must be relatively heavy and bulky in order to support a coil above the floor. In order to provide portatability, the reels may be provided with wheels, thus adding to the overall expense of such a dispensing device. Because the coil dispenser must be periodically moved from one portion of a building under construction to another, it is apparent that a large and bulky dispenser is undesirable.

Furthermore, because prior art coil dispensers are typically floor supported, the cable is therefore situated somewhat remotely from the ceiling or other regions where cable must be installed.

While it has also been proposed to mount a reel of electrical cable on a device which is connected to a building stud member, such devices are not readily adaptable to different sized building stud members and, furthermore, are generally quite large and bulky.

SUMMARY OF THE INVENTION

The present invention is directed to providing a clamp bracket which is readily connected to a building stud member for suspending a coil of electrical cable therefrom. Accordingly, the present invention contemplates a member having a first end formed with an angle or bend which is dimensioned to fit partially around a building stud member. A remainder portion of the member extends from the angled or bent portion outwardly from the stud member so that an elongate pivot arm may be pivotally connected thereto. The pivotal connection is intermediate the ends of the pivot arm to permit one end of the pivot arm to be urged against the stud when a weight such as a coil of cable is connected to the other end, the first end of the pivot arm being urged against the stud so as to clamp and frictionally engage the stud between the angled portion and the pivot arm. The clamp bracket may be positioned along the stud at any desired location.

It is a general object of the present invention to provide a clamp bracket for supporting cable which is readily adapted to be removably clamped to studs of different sizes.

It is another object of the present invention to provide a clamp bracket for removable clamping to a building stud member which requires only a single angled or generally channel-shaped end for being situated partially around the stud. Such an end permits the clamp bracket to be moved laterally toward or away from the stud for engagement or removal.

Another object of the present invention is to provide a clamp bracket for being removably clamped to a building stud member which utilizes a pivotally connected, elongate pivot arm for holding cable which includes a foot for engaging the stud to urge the channel-shaped end of the bracket into engagement with the stud.

Yet another object of the present invention is to provide a clamp bracket for removable clamping to a building stud member which may be readily removed from a clamped position on one stud and easily transported to position for being clamped onto another stud.

Additional objects of the present invention reside in the specific construction of the exemplary device hereinafter particularly described in the specification and shown in several drawings.

BRIEF DESCRIPTION OF THE DRAWINGS

Novel features of the cable holding clamp bracket in accordance with the present invention will be more readily understood when a consideration of the following description taken together with the accompanying drawings, in which a preferred embodiment is illustrated with the various parts thereto identified by suitable reference characters in each of the views, in which.

DETAILED DESCRIPTION OF THE INVENTION

Figure 1:
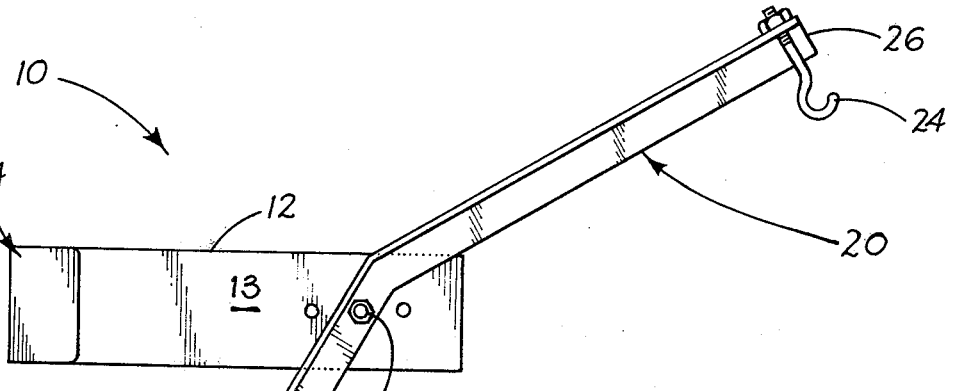
FIG. 1 is a side elevation view of a clamp bracket of the present invention illustrating a pivot arm in open position preparatory to mounting the bracket onto a stud.
Figure 2:
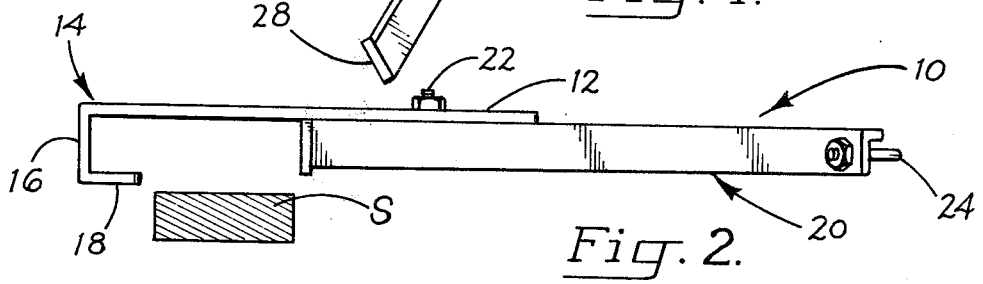
FIG. 2 is a top plan view of the clamp bracket of FIG. 1 and shows the clamp bracket positioned adjacent the side a stud preceding engagement of the clamp bracket with the stud.

Referring to the drawings, and more particularly to FIGS. 1 and 2, a stud grip or clamp bracket in accordance with the present invention is generally designated at 10. The clamp bracket 10 includes a single elongate support member 12 formed as an elongate plate having a coplanar surface 13 and an end 14 formed with a bend or angle. For instance, as shown in FIG. 2, the end 14 is constructed with a channel-shaped portion having sides 16 and 18.

An elongate pivot arm, generally designated at 20 is pivotally connected to the remainder portion of the member 12 by means of a pivot pin or bolt 22 for swinging alongside coplanar surface 12*a*. The pivot arm 20 is illustrated as being constructed from a piece of angle material for providing additional strength and rigidity.

It is to be noted that the pivot arm 20 is provided with a bend intermediate its length and includes an aperture from which a hook 24 or the like may be rigidly suspended as shown adjacent an end 26. A plate 28 is attached to the other end of pivot arm 20 and serves to distribute clamping forces over the plate area against a stud.

Figure 3:
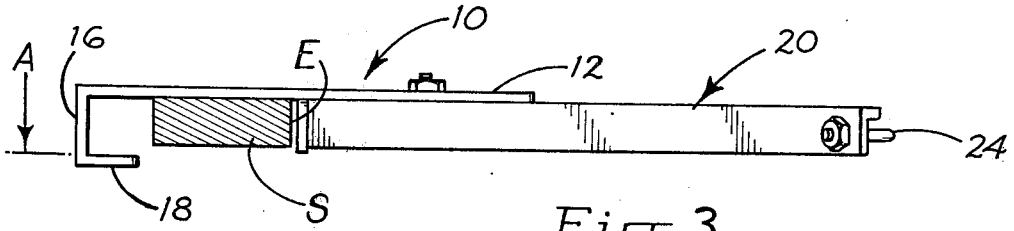
FIG. 3 is a view similar to FIG. 2 but illustrates the clamp bracket after being moved laterally toward a stud for contact with a stud face.
Figure 4:
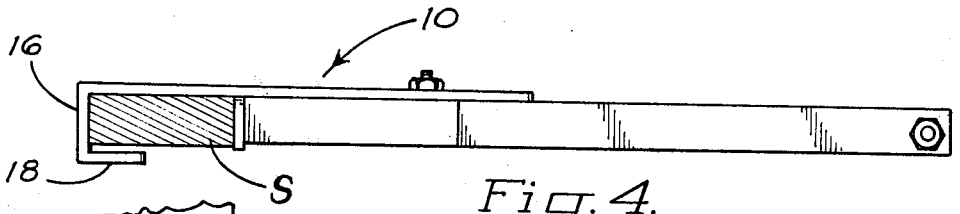
FIG. 4 is a view similar to FIG. 3 and illustrates the clamp bracket engaging the stud member such that the stud is frictionally engaged between the pivot arm and the angled end portion.

From a consideration of FIGS. 2–4, it may be readily appreciated how quickly and efficiently the clamp bracket 10 of the present invention may be situated so as to be clamped to a building stud member. Initially, as shown in FIG. 2, the clamp bracket 10 is positioned alongside a building stud member S at a desired height location. The bracket 10 is then moved laterally with respect to the stud S generally in the direction of arrow A so that a side of the member 12 engages the stud S. As shown in FIG. 4, the clamp bracket 10 is then moved in a direction substantially parallel to a face of the stud S such that the channel-shaped end 14 extends about a peripheral portion of the stud S. The pivot arm 20 is then swung into a stud engaging position as shown in FIG. 3. Because the pivot arm is provided with a bend, it extends diagonally toward the stud in a downward direction for contact thereagainst to provide a clamping brace which may be quickly swung to a position disengaged from the stud.

Figure 5:
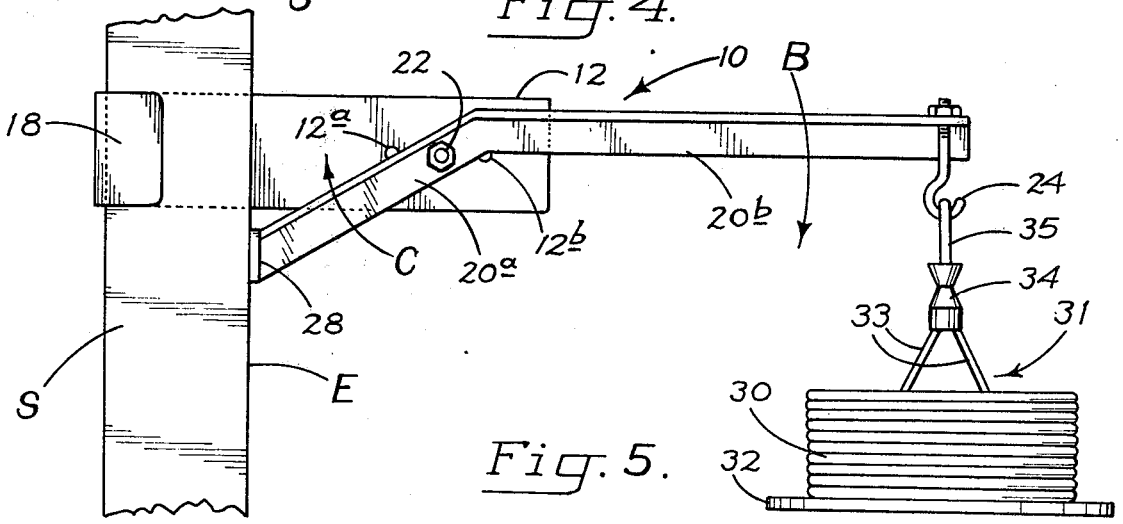
FIG. 5 is a side view of the clamp bracket of the present invention mounted in stud engaging position supporting a coil of cable on a reel for paying out the cable.

With reference now directed particularly to FIG. 5, the clamp bracket 10 is shown supporting a coil of cable 30 which is mounted upon a base 32. The base 32 includes rod or cage members 33 connected to a swivel 34 and a connector 35 which is mounted on the hook 24. Weight from the cable 30 and the reel 31 provides a moment about the bolt 22 in the direction of arrow B. This moment urges the arm segment 20*a* in the direction of arrow C so that the foot plate 28 frictionally engages an edge E of the stud S. The moment B is also transferred through the pivot connection 22 to the member 12 so as to urge the portion 16 against its adjacent edge of the stud S. The stud S is thereby frictionally engaged between the end portion 14 and the foot plate 28. As can be seen, the clamp bracket 10 is rigidly clamped to the stud S to permit cable from the coil 32 to be paid out for installation at desired locations.

To shift the location of the clamp bracket 10 vertically along the stud S, a force is applied to the pivot arm 20 to disengage the foot plate 28 from contact against the edge E of the stud S. The member 12 may then be positioned as desired. It can be seen that the arm length 20*b* is dimensioned so that the clamp bracket 10 may be situated about the stud S and held there without weight from the cable 30. This permits an electrician or other worker to position the clamp bracket 10 in a desired location and then have both hands free to lift the cable 30 and the reel 31 into place for mounting onto the hook 24.

Another advantage of the present invention resides in the adaptability of the clamp bracket 10 to different sized studs. Apertures 12*a* and 12*b* are provided in the member 12 so that the pivot arm 20 may be selectively connected at different pivot locations to permit the clamp bracket 10 to engage a smaller or larger sized stud. For instance, the pivot arm 20 may be pivotally connected through the apertures 12*a* or 12*b* to permit the clamp bracket 10 to be removably clamped to a stud member smaller or larger than the illustrated stud S. Such adaptability is of importance when coil must be installed by an electrician in different parts of a home or building in which the building stud members are of different sizes.

Another advantage of the present invention resides in the use of the foot plate 28 for distributing pressure from a load over a stud surface area. For instance, thin metal studs may offer little in the way of lateral resistance, and thus it is desirable to have non-point contact of the pivot arm 20 with such a metal stud.

From the above, it can be appreciated that the clamp bracket 10 of the present invention is readily transportable and adaptable to different sized building studs and yet is relatively lightweight and compact. It may be situated in areas of limited accessability. As such, it may also be transported from various working areas within a home or building or from jobsite to jobsite without requiring excessive space or manpower to handle it.

While the invention has been particularly shown and described with reference to the foregoing preferred embodiment, it will be understood by those skilled in the art that other changes in form and detail may be made therein without departing from the spirit and scope of the invention as defined in the appended claims.

What is claimed is:

1. A stud grip for removable mounting on a rectilinear building stud and for holding a load comprising:

a single bracket member formed as an elongate plate having a coplanar surface and an end formed with a bend dimensioned to extend around a peripheral portion of the stud so the coplanar surface contacts the stud and a remainder portion of said bracket member extends outwardly from the stud; and a pivot arm pivotally connected intermediate its ends to said remainder portion for holding the load, said pivot arm being operable for selective swinging alongside said coplanar surface between a stud engaged position and a disengaged position, said stud engaged position being defined by one of said ends of said pivot arm extending diagonally downward toward the stud with said end of the pivot arm contacting the stud to thereby clamp a surface portion of the bend in a flush manner against the stud, said clamping being effected by load weight on the other said end of said pivot arm, and said disengaged position being defined by said pivot arm noncontacting the stud so that said bend is released from being clamped to thereby permit removal of said bracket member laterally from the stud.

2. The stud of claim 1, wherein said bend is generally channel-shaped and dimensioned to generally conform to the peripheral portion of a stud about which said bend is to extend.

3. The stud grip of claim 1, wherein said pivot arm includes a foot plate mounted on one end thereof, said plate being arranged for substantially flush contact with the stud when said pivot arm is disposed in said stud engaging position.

4. The stud grip of claim 2, wherein said remainder portion includes means for locating said pivot arm at selected pivot points.

5. The stud grip of claim 2, wherein said pivot is provided with means for holding a coil of cable so that the coil may be rotatably suspended therefrom.

6. The stud grip of claim 5, wherein said holding means includes a swivel to which is connected a reel, said reel adapted to hold a coil of cable and rotatable about said swivel to permit reeling in or paying out of cable.

* * * * *

UNITED STATES PATENT AND TRADEMARK OFFICE

CERTIFICATE OF CORRECTION

PATENT NO. : 4,167,255

DATED : September 11, 1979

INVENTOR(S) : Laurence B. Benson

It is certified that error appears in the above-identified patent and that said Letters Patent are hereby corrected as shown below:

In the claims:

Claim 2, column 4, line 49, after the word "stud", add --grip--.

Claim 5, column 4, line 60, after the word "pivot", add --arm--.

Signed and Sealed this

*Twenty-second* Day of *July 1980*

[SEAL]

*Attest:*

SIDNEY A. DIAMOND

*Attesting Officer*

*Commissioner of Patents and Trademarks*